US008228355B2

(12) United States Patent
Sasaki

(10) Patent No.: US 8,228,355 B2
(45) Date of Patent: Jul. 24, 2012

(54) DISPLAY DEVICE AND DISPLAY METHOD

(75) Inventor: Takanobu Sasaki, Kumagaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/721,382

(22) Filed: Mar. 10, 2010

(65) Prior Publication Data

US 2011/0080431 A1 Apr. 7, 2011

(30) Foreign Application Priority Data

Oct. 2, 2009 (JP) ..... 2009-230311

(51) Int. Cl.
*G09G 3/36* (2006.01)

(52) U.S. Cl. ..... 345/690; 345/101; 345/102

(58) Field of Classification Search ..... 345/87–104, 345/204; 22/101, 102
See application file for complete search history.

(56) References Cited

U.S. PATENT DOCUMENTS 6,710,762 B1 * 3/2004 Hasegawa ..... 345/101
2004/0201564 A1 * 10/2004 Sugino et al. ..... 345/101
2004/0207588 A1 * 10/2004 Shiomi ..... 345/87
2007/0229443 A1 10/2007 Sanada et al.
2008/0238860 A1 10/2008 Onodera

FOREIGN PATENT DOCUMENTS

JP 2006-011086 1/2006
JP 2006-147373 6/2006
JP 2007-298957 11/2007
JP 2008-249780 10/2008

* cited by examiner

*Primary Examiner* — Stephen Sherman
(74) *Attorney, Agent, or Firm* — Blakely, Sokoloff, Taylor & Zafman LLP

(57) ABSTRACT

A display device according to an aspect of the present invention includes: a display configured to have a backlight; a driver configured to drive the backlight; first and second temperature measurement modules, configured to measure temperatures of the display device, disposed in different positions in the display; a first comparison module configured to compare the temperature measured in the first temperature measurement module with a first threshold value; a second comparison module configured to compare the temperature measured in the second temperature measurement module with a second threshold value different from the first threshold value; and a controller controlling an output current value of the driver based on a comparison result in the first comparison module and the second comparison module.

8 Claims, 4 Drawing Sheets

| TEMPERATURE SENSOR | THRESHOLD VALUE |
|---|---|
| A | 75°C |
| B | 78°C |
| C | 76°C |
| D | 69°C |
| E | 76°C |
| F | 72°C |

DISPLAY DEVICE AND DISPLAY METHOD

CROSS-REFERENCE TO RELATED APPLICATIONS

This application is based upon and claims the benefit of priority from the prior Japanese Patent Application No. 2009-230311, filed on Oct. 2, 2009; the entire contents of which are incorporated herein by reference.

BACKGROUND OF THE INVENTION

1. Field of the Invention

The present invention relates to a display device having a backlight and a display method.

2. Description of the Related Art

In some of conventional display devices, a plurality of temperature sensors are disposed in a liquid crystal display panel, and when a difference between respective temperatures measured by the plural temperature sensors exceeds a predetermined threshold value, a driving condition of a liquid crystal element of the above-described liquid crystal display panel is altered (JP-A 2007-298957 (KOAKI)).

BRIEF SUMMARY OF THE INVENTION

In recent years, some casings covering display panels are formed of metal such as aluminum in order to improve design. Since metal has a high thermal conductivity, heat of a backlight is easily conveyed to the casing, thereby raising a temperature of a casing surface. However, in a convention display device, though a driving condition of a liquid crystal element is altered, a temperature of a casing surface is not taken into consideration. In view of the above, the present invention is made to solve such a conventional problem and an object of the present invention is to provide a display device and a display method capable of suppressing a temperature rise of a casing surface effectively.

A display device according to an aspect of the present invention includes: a display configured to have a backlight; a driver configured to drive the backlight; first and second temperature measurement modules, configured to measure temperatures of the display device, disposed in different positions in the display; a first comparison module configured to compare the temperature measured in the first temperature measurement module with a first threshold value; a second comparison module configured to compare the temperature measured in the second temperature measurement module with a second threshold value different from the first threshold value; and a controller controlling an output current value of the driver based on a comparison result in the first comparison module and the second comparison module.

A display method according to an aspect of the invention includes: measuring temperatures of first and second positions different from each other in a display having a backlight; comparing the temperature of the first position with a first threshold value; comparing the temperature of the second position with a second threshold value different from the first threshold value; and suppressing an output current value to the backlight based on a result of the comparison.

DETAILED DESCRIPTION OF THE INVENTION

Hereinafter, embodiments of the present invention will be described in detail with reference to the drawings.

First Embodiment

Figure 1:
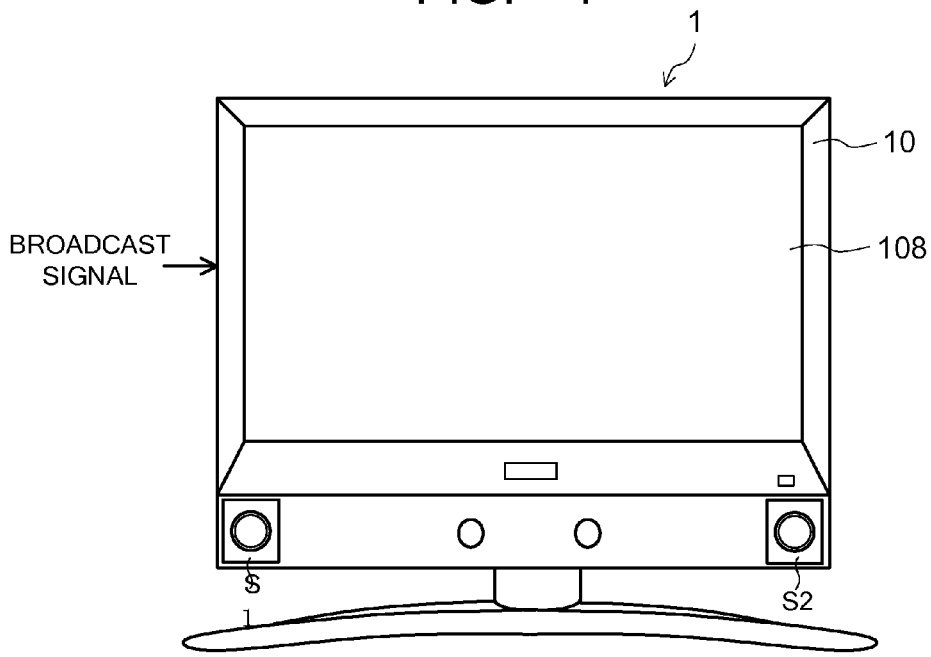
FIG. 1 is a view showing a display device according a first embodiment.
Figure 2:
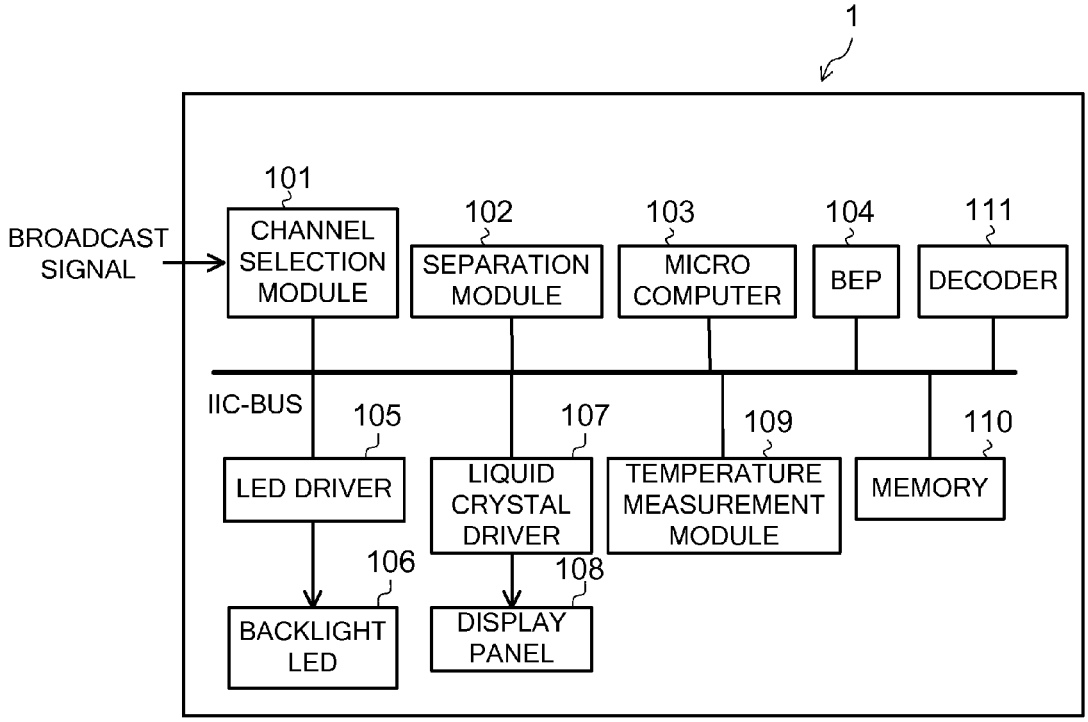
FIG. 2 is a diagram showing a configuration of the display device according to the first embodiment.

FIG. 1 is a view showing a display device according to a first embodiment. FIG. 2 is a diagram showing a configuration of the display device according to the first embodiment. In the first embodiment, a liquid crystal television 1 (hereinafter, liquid crystal TV 1) is described as a concrete example of the 0020 display device. It should be noted that the display device is not limited to the liquid crystal TV 1. The display device can be one having a backlight such as a cellular phone and a PDA for example.

The liquid crystal TV 1 has a display panel 108, speakers S1, S2 and the like in a front surface. The liquid crystal TV 1 decodes a digital broadcast signal inputted from a not-shown antenna, thereby reproducing a video and an audio. Metal such as aluminum is used for a casing 10 to cover surroundings of the display panel 108 in order to improve design. A material of the casing 10 is not limited to the metal but other materials such as plastic for example can be used.

Since the metal has a high thermal conductivity, there is a tendency that heat can be easily felt when a surface of the casing 10 is touched. A main cause of a temperature rise of the display panel 108 and its casing 10 is a backlight. The liquid crystal TV 1 according to the first embodiment suppresses the temperature rise of the display panel 108 and its casing 10 by suppressing an illuminance of the backlight.

As shown in FIG. 2, the liquid crystal TV 1 has a channel selection module 101, a separation module 102, a microcomputer 103, a BEP (back end processor) 104, an LED driver 105, a backlight LED 106, a liquid crystal driver 107, the display panel 108, a temperature measurement module 109, a memory 110, and a decoder 111.

The channel selection module 101 selects a desired channel from the broadcast signal received by the antenna. The channel module 101 demodulates the selected broadcast signal, thereby generating a TS (transport stream).

The separation module 102 separates the broadcast signal, SI/PSI and the like from the TS generated in the channel selection module 101. The TS is a multiplexed signal which includes the broadcast signal and SI/PSI. The broadcast signal is a broadcast signal of MPEG-2 for example. The broadcast signal is constituted by an audio ES (audio elementary stream) and a video ES (video elementary stream) made by encoding a video and an audio respectively. The PSI is information which records what program exists in the TS and what program each ES which is included in the TS belongs to. Further, the SI includes EPG (electric program guide) information (hereinafter, program information).

The decoder 111 decodes the audio ES and the video ES separated in the separation module 102, thereby generating an audio signal and a video signal. The decoder 111 inputs the generated video signal to the BEP 104. The decoder 111 inputs the generated audio signal to the speakers S1, S2. The speakers S1, S2 output an audio based on the inputted audio signal.

The microcomputer 103 suppresses an output current to the backlight LED 106 based on a temperature measured in the temperature measurement module 109. As a result, an illuminance of the backlight is suppressed. Suppression of the illuminance of the backlight leads to suppression of the temperature rise of the display panel 108 and its casing 10. It should be noted that a suppressing method of an output current by the microcomputer 103 will be described later.

The BEP 104 controls the LED driver 105 and the liquid crystal driver 107 based on the video signal inputted from the decoder 111 and displays an image corresponding to the video signal in the display panel 108.

The LED driver 105 drives the backlight LED 106 based on control from the BEP 104. The LED driver 105 has thirty-two driver ICs of a driver IC 1 to a driver IC 32. Each of the driver IC 1 to the driver IC 32 adjusts an output current to the backlight LED 106 by PWM (pulse width modulation) control.

Figure 3:
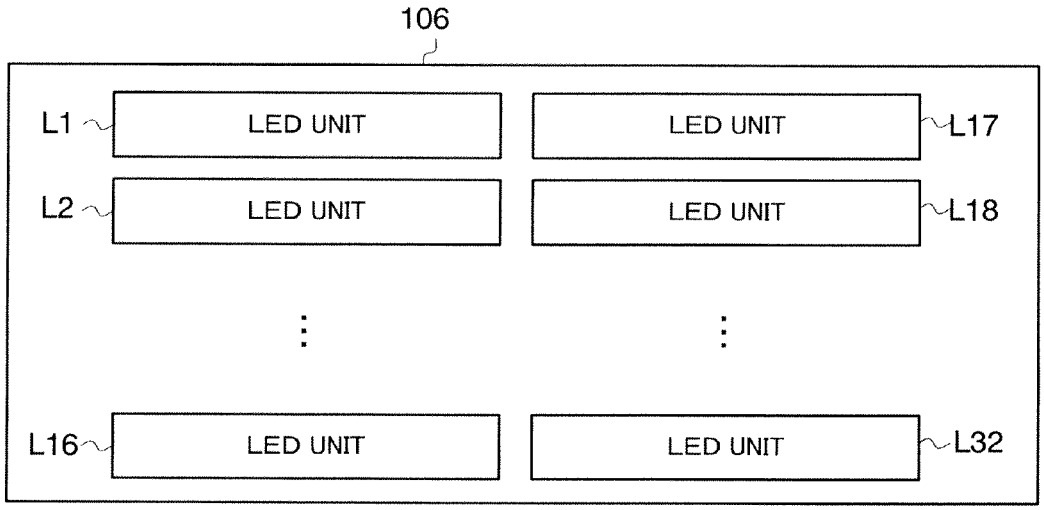
FIG. 3 is a diagram showing a configuration of an LED backlight.

FIG. 3 is a diagram showing a configuration of the backlight LED 106. The backlight LED 106 has thirty-two LED units of an LED unit L1 to an LED unit L32 corresponding to the driver IC 1 to the driver IC 32. Further, though not shown, the LED units each have sixteen LED blocks and a plurality of LEDs are arranged in each LED block.

The respective driver IC 1 to the driver IC 32 independently drive the sixteen LED blocks which the corresponding LED unit L1 to LED unit L32 each have. It should be noted that the number of the driver ICs and the LED units is not limited to thirty-two. Further, the number of the LED blocks each LED unit has is not limited to sixteen, and the number of the LEDs in the block is not limited, either.

The liquid crystal driver 107 drives a liquid crystal element of the display panel 108 based on control from the BEP 108.

Figure 4:
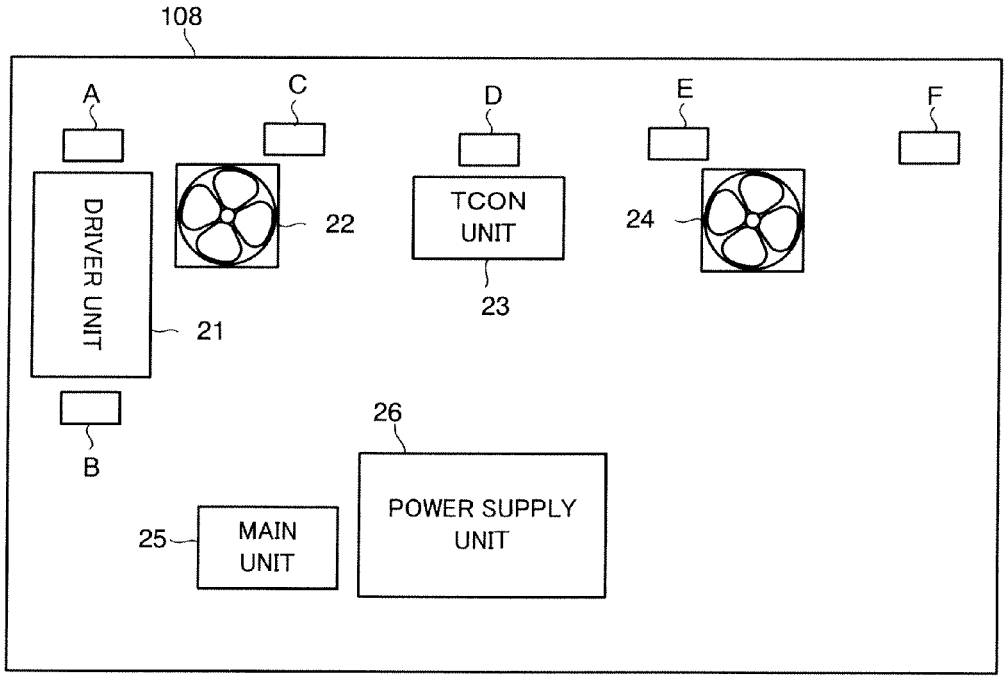
FIG. 4 is a diagram showing arrangement positions of temperature sensors.

The temperature measurement module 109 has a plurality of temperature sensors of a temperature sensor A to a temperature sensor F disposed in the display panel 108. FIG. 4 is a diagram showing arrangement positions of the temperature sensor A to the temperature sensor F. FIG. 4 shows a rear surface of the display panel 108. In the rear surface of the display panel 108, there are disposed a driver unit 21, fans 22, 24, a TCON unit 23, a main unit 25, a power supply unit 26, and the like.

The driver unit 21 has a driver (for example, the LED driver 105) for driving the display panel 108. The fans 22, 24 are cooling fans disposed on the back of the display panel 108. The TCON (timing controller) unit 23 is a logic circuit for taking timing of video display and outputs a pulse such as a shift clock. The main unit 25 processes the inputted broadcast signal. More specifically, the main unit 25 has the channel selection module 101, the separation module 102, the microcomputer 103, the BEP 104, the decoder 111 and the like shown in FIG. 2. The power source unit 26 converts an alternating current supplied from a household power source and the like into a direct current and supplies to the respective portions (for example, the driver unit 21, the fans 22, 24, the TCON unit 23 and the like) of the liquid crystal TV 1.

The temperature sensors A, B are disposed above and beneath the driver unit 21, respectively. The temperature sensor C is disposed in an upper right part of the fan 22. The temperature sensor D is disposed in an upper part of the TCON unit 23. The temperature sensor E is disposed in an upper left part of the fan 24. The temperature sensor F is disposed in an upper right side of the display panel 108. Each of the temperature sensor A to the temperature sensor F detects a temperature of the disposed position. In an example shown in FIG. 4, the temperature sensor A to the temperature sensor F are disposed mainly in an upper part (upper side of the center) of the display panel 108. This is because the upper part of the display panel 108 tends to have a higher temperature and the temperature rise of the casing 10 can be suppressed more effectively when the temperature sensor is disposed in the upper part of the display panel 108. It should be noted that the number of the temperature sensors and the arrangement positions of the respective temperature sensors are not limited to the example shown in FIG. 4.

Figures 5, 6:
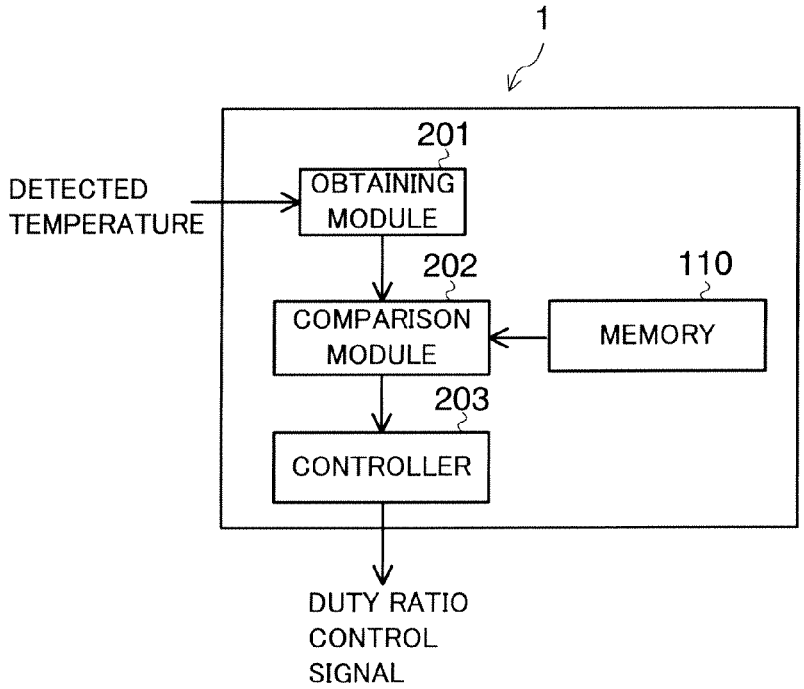
FIG. 5 is a diagram showing table data of a memory.
FIG. 6 is a diagram showing a functional configuration of the display device according to the first embodiment.

FIG. 5 is a diagram showing table data stored in the memory 110. The memory 110 stores table data in which the temperature sensor A to the temperature sensor F and threshold values are made to correspond to each other. In an example shown in FIG. 5, the threshold values of the temperature sensor A to the temperature sensor F are set to 75° C., 78° C., 76° C., 69° C., 76° C., and 72° C., respectively. The respective threshold values of the table data are set so that surface temperatures of the display panel 108 and the casing 10 covering the display panel 108 become equal to or lower than 65° C.

It should be noted that a correlation between a temperature detected by the temperature sensor and surface temperatures of the display panel 108 and the casing 10 covering the display panel 108 differs depending on the arrangement positions of the temperature sensor A to the temperature sensor F. In the first embodiment, by giving the threshold value per temperature sensor, an optimal threshold value is set in correspondence with the arrangement positions of the temperature sensor A to the temperature sensor F.

FIG. 6 is a diagram showing a functional configuration of the liquid crystal TV 1 according to the first embodiment. Hereinafter, the functional configuration of the liquid crystal TV 1 according to the first embodiment will be described with reference to FIG. 6. The liquid crystal TV 1 has an obtaining module 201, a comparison module 202, a controller 203 and the memory 110.

The obtaining module 201 obtains the temperatures detected in the temperature sensor A to the temperature sensor F which the temperature measurement module 109 has at regular time intervals.

The comparison module 202 compares the temperature obtained in the obtaining module 201 with the threshold value with reference to the memory 110. The comparison module 202 compares the temperatures detected in the temperature sensor A to the temperature sensor F with the corresponding threshold values, respectively.

The controller 203 controls output currents of the driver IC 1 to the driver IC 32 which the LED driver 105 has, based on a comparison result in the comparison module 202. More specifically, the controller 203 alters duty ratios of the driver IC 1 to the driver IC 32 while the temperatures detected in the temperature sensor A to the temperature sensor F exceed the corresponding threshold values, thereby reducing the output currents by one percent at regular time intervals (for example, every several seconds).

When the temperatures detected in the temperature sensor A to the temperature sensor F become equal to or lower than the threshold values, the controller 203 sets the duty ratios of the driver IC 1 to the driver IC 32 back to duty ratios before alteration. On this occasion, the controller 203 raises the output currents by one percent at regular time intervals (for example, every several seconds).

By setting the duty ratios of the driver IC 1 to the driver IC 32 back to the duty ratios before alteration when the detected temperatures become equal to or lower than the threshold values, it is possible to shorten a time during which an image displayed in the display panel 108 becomes dark.

Figure 7:
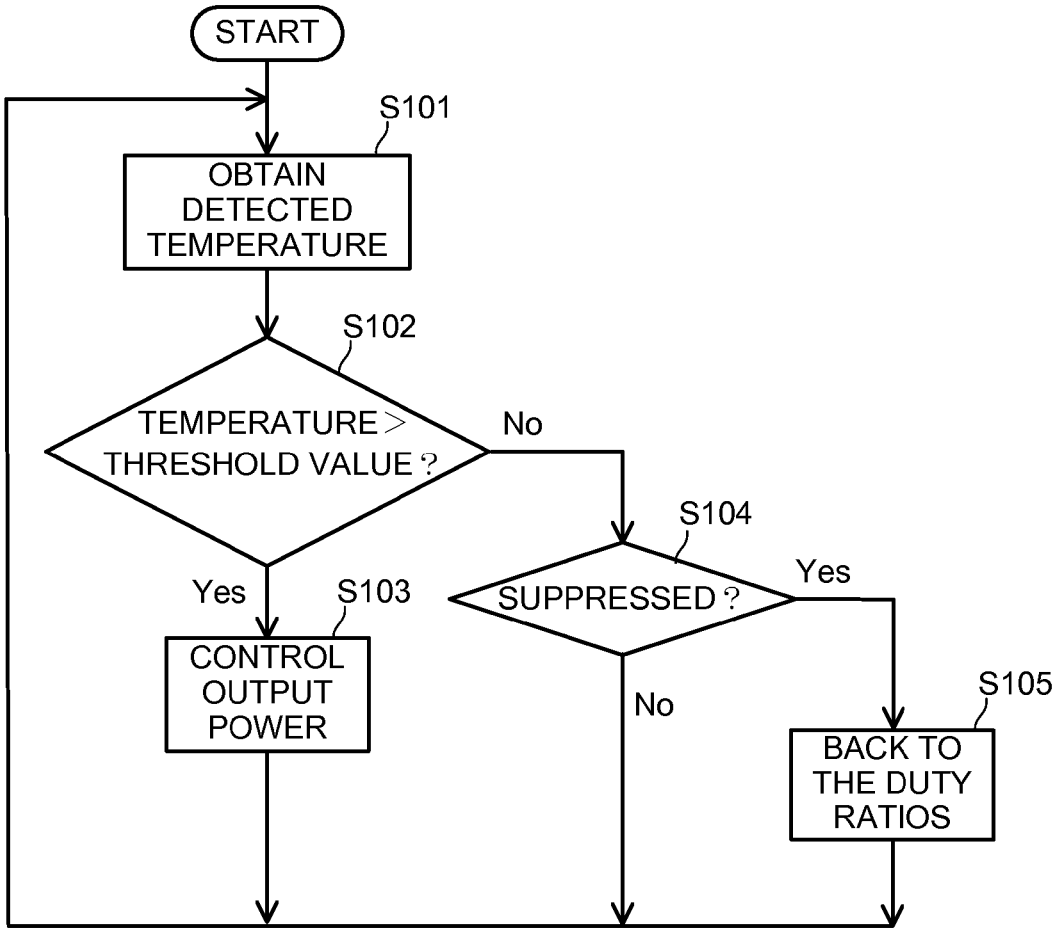
FIG. 7 is a flowchart showing an operation of the display device according to the first embodiment.

FIG. 7 is a flowchart showing an operation of the liquid crystal TV 1 according to the first embodiment.

The obtaining module 201 obtains the temperatures detected in the temperature sensor A to the temperature sensor F which the temperature measurement module 109 has (step S101).

The comparison module 202 compares the temperature obtained in the obtaining module 201 with the threshold value with reference to the memory 110 (step S102).

If the temperature obtained in the obtaining module 201 exceeds the threshold value of the table data stored in the memory 110 (Yes in the step S102), the controller 203 alters the duty ratios of the driver IC 1 to the driver IC 32 which the LED driver 105 has, thereby reducing the output currents by one percent at regular time intervals (step S103).

If the temperature obtained in the obtaining module 201 does not exceed the threshold value of the table data stored in the memory 110 (No in the step S102), the controller 203 judges whether or not the output voltages of the driver IC 1 to the driver IC 32 which the LED driver 105 has are suppressed (step S104).

If the output voltages are suppressed (Yes in the step S104), the controller 203 sets the duty ratios of the driver IC 1 to the driver IC 32 back to the duty ratios before alteration (step S105). On this occasion, the controller 203 raises the output currents by one percent at regular time intervals.

Further, in a case that the output voltages are not suppressed (No in the step S104), if an action of the step S103 or the step S105 is finished, a procedure goes back to an action of the step S101. The obtaining module 201 to the controller 203 repeat the actions of the step S101 to the step S105 at predetermined time intervals.

As stated above, the liquid crystal TV 1 according to the first embodiment has the plurality of temperature sensors of the temperature sensor A to the temperature sensor F disposed in the display panel 108 and compares the temperatures detected in these temperature sensor A to temperature sensor F with the threshold values. Then, if the detected temperature exceeds the threshold value, the output current of the driver IC driving the backlight is suppressed.

Accordingly, even if a material having a high thermal conductivity such as metal is used for a casing covering a display panel 108, a rise of a surface temperature of a casing 10 can be suppressed. Further, when the temperatures detected in the temperature sensor A to the temperature sensor F become equal to or lower than the corresponding threshold values, the controller 203 sets the duty ratios of the driver IC 1 to the driver IC 32 back to the duty ratios before alteration. It is possible to shorten a time during which an image displayed in the display panel 108 becomes dark.

Other Embodiment

It should be noted that the present invention is not limited to the above-described embodiment as it is, and can be concretized by modifying components in a range not deviating from the gist in an execution phase. For example, in the first embodiment the output currents of the driver IC 1 to the driver IC 32 are suppressed when the temperatures detected in the temperature sensor A to the temperature sensor F exceed the threshold values, but the output currents of the driver IC 1 to the driver IC 32 can be independently suppressed. More specifically, it can be constituted to suppress only an output current to a driver IC outputting a current to an LED unit in a region close to a position where the temperature sensor whose measured temperature exceeds a threshold value is disposed.

What is claimed is:

1. A display device, comprising:

a display configured to have a backlight;

a driver configured to drive the backlight;

first and second temperature measurement modules, configured to measure temperatures of the display device, disposed in different positions in the display;

a comparison module configured to exclusively compare the temperature measured in the first temperature measurement module with a first threshold value and configured to exclusively compare the temperature measured in the second temperature measurement module with a second threshold value different from the first threshold value; and a controller configured to control an output current value of the driver based on a comparison result in the comparison module.

2. The display device of claim 1, wherein the first and second temperature measurement modules comprise at least one temperature sensor.

3. The display device of claim 1, wherein the backlight has a plurality of light-emitting parts disposed in different positions in the display; and wherein the controller suppresses an output current value to the light-emitting part disposed in a region corresponding to one of the first and second temperature measurement modules in which the measured temperature exceeds the first or second threshold value of the first and second temperature measurement modules.

4. The display device of claim 1, wherein the controller decreases the output current value of the driver at a predetermined rate while the temperature measured in the first or second temperature measurement module exceeds the first or second threshold value.

5. The display device of claim 1, wherein at least one of the first and second temperature measurement modules is disposed in an upper side of the display.

6. The display device of claim 1, wherein the first threshold value and the second threshold value are directly associated with the first temperature measurement module and the second temperature measurement module, respectively.

7. A method comprising:

measuring temperatures of first and second positions different from each other in a display having a backlight;

exclusively comparing the temperature of the first position with a first threshold value and exclusively comparing the temperature of the second position with a second threshold value different from the first threshold value; and suppressing an output current value to the backlight based on a result of the comparison.

8. The method of claim 7, wherein the first threshold value and the second threshold value are directly associated with a first temperature measurement module and a second temperature measurement module, respectively.

* * * * *